United States Patent [19]

Schiffer et al.

[11] 4,214,461

[45] Jul. 29, 1980

[54] DEVICE FOR WET TREATING, ESPECIALLY DYEING AND IMPREGNATING, TEXTILE WEBS IN A CONTINUOUS MANNER

[75] Inventors: Günter Schiffer, Krefeld; Klaus Meisen, Tönisvorst; Rudolf Sunnen; Klaus Heidan, both of Krefeld, all of Fed. Rep. of Germany

[73] Assignee: Kleinewefers GmbH, Krefeld, Fed. Rep. of Germany

[21] Appl. No.: 962,626

[22] Filed: Nov. 21, 1978

[30] Foreign Application Priority Data

Nov. 22, 1977 [DE] Fed. Rep. of Germany ..... 2752011

[51] Int. Cl.[2] ..... D06B 3/22

[52] U.S. Cl. ..... 68/158

[58] Field of Search ..... 68/158, 175, 46, 47, 68/43, 22 R; 134/64 R, 64 P, 122 R, 122 P, 9, 15; 118/419, 420, 427

[56] References Cited

U.S. PATENT DOCUMENTS

| | | | |
|---|---|---|---|
| 2,977,662 | 4/1961 | Freeze et al. | 68/22 R X |
| 3,247,664 | 4/1966 | Reeder et al. | 68/175 X |
| 3,800,742 | 4/1974 | Hunter | 118/246 |

FOREIGN PATENT DOCUMENTS

| | | | |
|---|---|---|---|
| 215764 | 6/1961 | Austria | 134/122 |
| 94403 | 8/1959 | Norway | 68/158 |
| 432094 | 7/1935 | United Kingdom | 68/43 |

*Primary Examiner*—Philip R. Coe

*Attorney, Agent, or Firm*—Becker & Becker, Inc.

[57] ABSTRACT

A device for wet treating, especially dyeing and impregnating, a textile web in a continuous manner, which comprises a liquid receiving and containing vat and a deviating drum or roller immersing into the vat and adapted to have looped around its respective lower section the textile web to be treated. The deviating roller or drum is hollow and free from axle journals. Above the respective upper circumferential section of the deviating roller and symmetrically arranged with regard to the longitudinal central plane of the deviating roller there are rolls engaged by the deviating roller in the floating working position of the deviating roller.

8 Claims, 4 Drawing Figures

Fig. 1
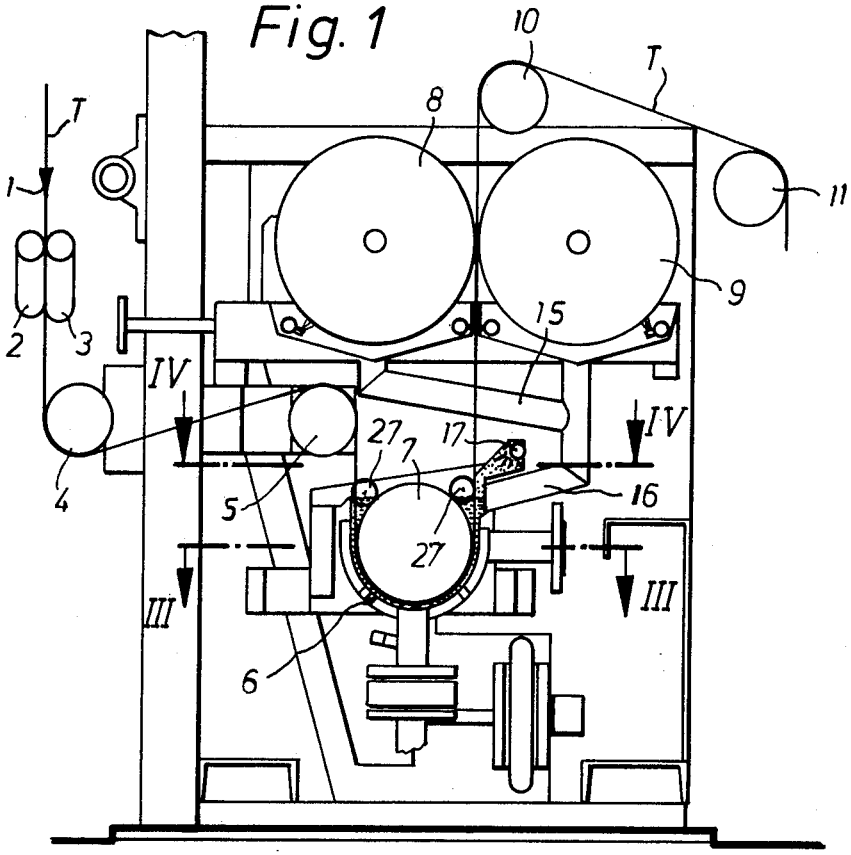
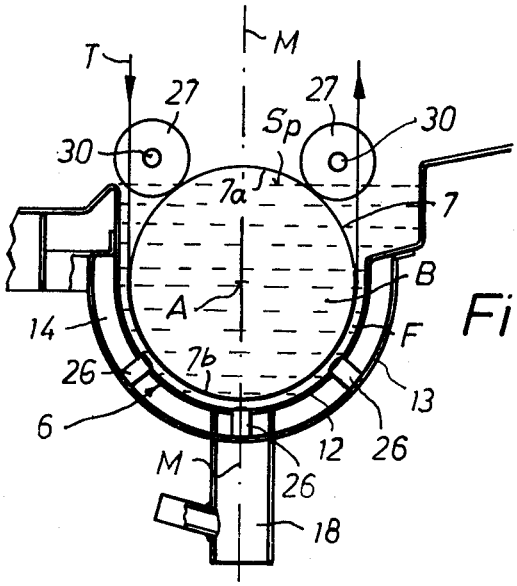
Fig. 2

DEVICE FOR WET TREATING, ESPECIALLY DYEING AND IMPREGNATING, TEXTILE WEBS IN A CONTINUOUS MANNER

The present invention relates to a device for a continuous wet treating, especially for dyeing and impregnating a textile web, which device comprises a liquid vat and a deviating roller adapted to immerse into the bath of the vat, while the textile web is looped around the respective lower circumferential section of the deviating roller.

Devices of this type are generally known in the textile treating art. If smaller quantities of textile webs are treated in the device, when changing the liquid, for instance when changing the dye, not only the withdrawal of the used up liquid and the supply of new liquid but also the cleaning of the vat, of the axle journals, and of the roller bearings on the walls of the vat take up a considerable time.

Accordingly, it is an object of the present invention to provide a device of the above mentioned general type in which not only a very small quantity of treatment liquid will be necessary, but in which also the necessary idle period can be considerably reduced.

It is a further object of this invention to provide a device as set forth in the preceding paragraph, according to which the structure of the device will be greatly simplified.

These and other objects and advantages of the invention will appear more clearly from the following specification in connection with the accompanying drawings, in which:

FIG. 1 is a side view of a device according to the present invention.

FIG. 2 shows the vat of FIG. 1, but on a considerably larger scale than that of FIG. 1.

Figure 3:
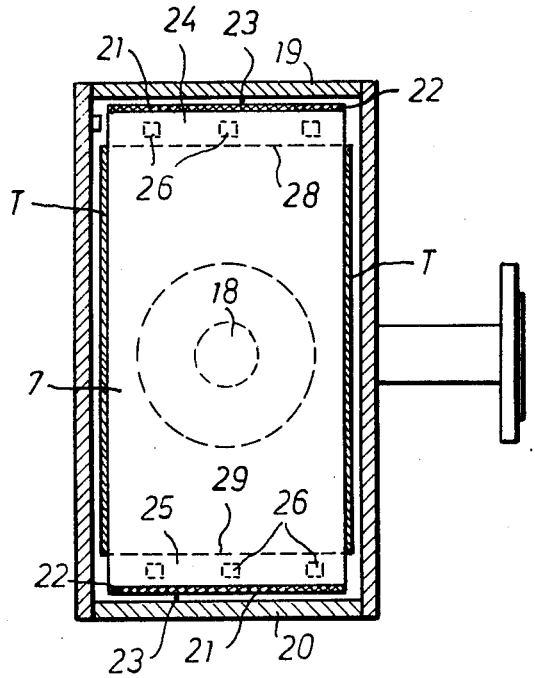
FIG. 3 is a section taken along the line III—III of FIG. 1, but likewise on a larger scale than that of FIG. 1.

The device according to the present invention is characterized primarily in that the deviating roller which immerses into the vat is hollow and free from axle journals while, above the respective upper circumferential section of the roller, rolls are journalled in a symmetrical arrangement with regard to the vertical longitudinal central plane, these rolls being engaged by the deviating roller in its floating working position.

Preferably, the rolls engage only the ends of the hollow deviating roller so that the textile web which is passed around the deviating roller in the vat is not contacted by the rolls because the latter are arranged at a greater distance than the width of the broadest textile web to be treated.

According to a further development of the invention, the rolls may be adjustable as to height and/or laterally.

To keep the quantity of liquid in the vat as small as possible so that no displacement body will be needed, it is provided according to a further development of the invention that the longitudinal central axis of the lower section of the liquid vat and the longitudinal axis of the deviating roller in its working position, and the distance between the lower section of the deviating roller and the lower section of the vat are less than 1/15 of the diameter of the deviating roller, preferably the diameter of the deviating roller may, for instance, be 200 mm and the distance between the lower section of the deviating roller and the lower section of the vat may amount to 8 mm.

In order during the emptying of the vat not to have to rest the deviating roller on the bottom of the vat, whereby the cleaning of the vat as well as the cleaning of the lower section of the deviating roller would be impeded, the lower region of the vat bottom is at the level of the ends of the deviating roller provided with small supporting cams or similar projections which are arranged symmetrically to the vertical central plane of the deviating roller. It is these cams or projections on which the ends of the roller which do not contact the web of textile material can rest and thus can be held in spaced relationship to the bottom of the vat. The cams or projections are so designed and arranged that the deviating roller in its working position in which it engages the rolls located above the deviating roller, will not rest on the cams or projections.

According to a further advantageous development of the device according to the invention, the end faces of the deviating roller are provided with a wear-resistant cover or layer which leaves a slight space between the end walls of the vat and the roller.

Preferably the bearings of the rolls arranged above the deviating roller are located above the vat overflow, or other means are provided in order to avoid a contact of these bearings with the treatment liquid in the vat.

The present invention is based on the idea of employing a floating deviating roller the position of which is not determined by the axle journals but is determined by the rolls which are provided above the deviating roller and which engage only the ends of the deviating roller laterally of the textile web. In view of these rolls, on the one hand, the movement of the deviating roller in upward direction is independent of the changing tension of the textile web and, on the other hand, a lateral movement of the deviating roller is excluded so that a uniform slight distance of the deviating roller from the walls of the vat is assured. Due to the buoyancy of the deviating roller, on the one hand, and the pull of the textile web, on the other hand, the deviating roller is kept in continuous engagement with the rolls without the necessity of providing the deviating roller with two axle journals which themselves and with their bearings would have to undergo a special cleaning, for instance, when changing the dye liquid.

Referring now to the drawings in detail, the textile web T to be treated passes in the direction of the arrow 1 between a pair of rolls 2, 3 in order, after being looped around two rolls 4, 5, to pass into the treatment vat 6 to be described further below where the textile web is looped around the deviating roller 7 and subsequently is passed between a pair of squeeze rolls 8, 9. From here the textile web T passes over two additional rolls 10, 11 out of the device.

The vat 6 has an inner wall 12 and an outer wall 13 (FIG. 2) which have a uniform distance from each other and form a space 14 which can be used for insulating, heating or cooling purposes. The vat 6 is filled with a treatment liquid B with the level Sp. To this end, the treatment liquid can from the squeeze rolls 8, 9 through feeding lines 15, 16 pass into the vat, or fresh liquid can be introduced into the vat through the conduit 17. The interior of the vat is in communication with a discharge conduit 18. The contents of the vat is controlled as to its level in the feeding conduit. The liquid taken along by the textile web T out of the vat is replaced by a corresponding quantity of additional liquid.

Figure 4:
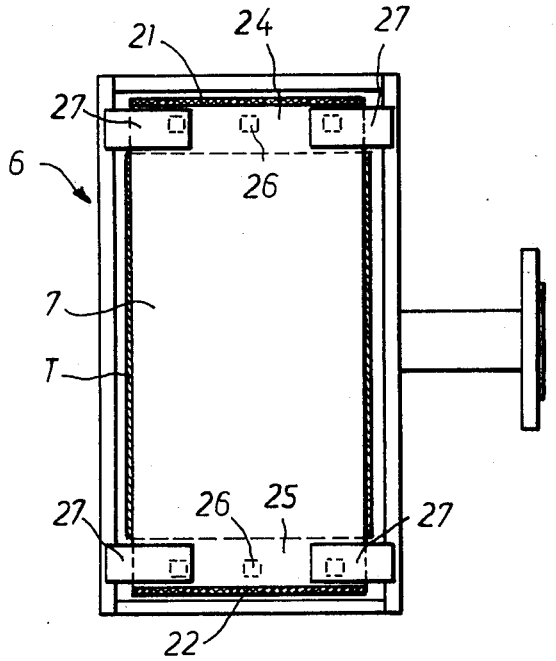
FIG. 4 is a section taken along the line IV—IV of FIG. 1, but likewise on a larger scale than that of FIG. 1.

As evident from FIGS. 1 and 2, the vat of approximately semicircular cross section receives the deviating roller 7 which is designed as a hollow drum and, as shown in FIGS. 3 and 4, is free from axle journals. The end faces 19, 20 of the vat, therefore, have no bearings which would have to be cleaned when changing the bath liquid in the vat 6. Similarly, there is no cleaning of the axle journals of the deviating roller 7.

The end faces 21 of the deviating roller 7 are provided with a wear-resistant cover or layer 22 which leaves a slight space 23 between the cover or layer 22 and the end walls 19, 20.

At the level of the ends 24, 25 of the deviating roller 7, cams 26 are provided on the vat bottom, which cams preferably rest on the bottom outer wall 13 and extend through the inner wall 12. The cams 26 are located symmetrically with regard to the central plane M of the vat 6 and of the deviating roller 7 in the working position thereof which will be described further below. The cams 26 which project to the same extent beyond the wall 12 of the vat bottom with their heads will, when the bath liquid is discharged from the vat 6, assure an approximately uniform distance of the deviating roller 7 from the bottom 12 of the vat, while the cams contact only the ends 24, 25 of the deviating roller 7.

When occupying its working position, the deviating roller 7 is in the position shown in FIGS. 1 and 2 and, due to the buoancy imparted thereupon by the bath liquid, as well as by the tension of the textile web T, with its respective upper circumferential section 7*a* engages four rolls 27 which in pairs are arranged at the level of the rim section 24, 25 of the deviating roller and thus, similar to the cams 26, are located laterally adjacent the rims 28, 29 of the textile web T. The four rolls 27 are symmetrically arranged with regard to the central plane M of the vat 6 and the deviating roller 7 as is the case with the cams 26. As a result thereof, not only the vertical position of the deviating roller 7 is fixed in its working position, but also a horizontal, which means lateral, deviation of the floating roller 7 is avoided. Preferably, the bearings 30 of the rolls 27 (FIG. 2) are so arranged that they cannot be reached by the liquid level Sp. To this end, a suitable overflow may be provided.

The axis A of the deviating roller 7 and the longitudinal axis of the vat 6 coincide in the working position of the roller 7 as shown in FIGS. 1 and 2, while the distance F between the lower deviating roller section 7*a* and the vat wall 12 is less than 1/15 of the diameter of the roller 7.

It is, of course, to be understood that the present invention is, by no means, limited to the particular showing in the drawings but also encompasses any modifications within the scope of the appended claims.

What we claim:

1. A device for wet treating, especially dyeing and impregnating, a textile web, which includes in combination: a vat having a lower section and a bottom to receive and contain a nominal quantity of treating liquid for treating the textile web to be treated, a deviating roller rotatably located in said vat and having axle journal-free end faces including marginal end zones, said deviating roller floating in the liquid in said vat, the lower section of which and said deviating roller being spaced from each other to receive therebetween successive textile web sections fed to the deviating roller in said lower section of said vat, and rotatable rolls arranged in pairs on both sides above said deviating roller and engaging marginal end zones only of said deviating roller, the rotatable rolls of each side of said deviating roller being spaced from each other.

2. A device in combination according to claim 1, in which said deviating roller is hollow.

3. A device in combination according to claim 1, in which said rolls are adjustable as to height.

4. A device in combination according to claim 1, in which said rolls are adjustable in the axial direction of said deviating roller.

5. A device in combination according to claim 1, in which the longitudinal central axis of a lower section of said vat at least nearly coincides with a longitudinal axis of said deviating roller in the working position of the latter, and in which in the floatingly supported working position of said deviating roller the distance between the respective lower deviating roller section and the vat bottom is less than 1/15 of the diameter of said deviating roller.

6. A device in combination according to claim 1, in which the lower section of the bottom of said vat within the region of the marginal ends of said deviating roller is provided with projecting means projecting into the interior of said vat for preventing said deviating roller from contact with the lower inner bottom surface of said vat, said projecting means being spaced from said deviating roller in the working position of the latter.

7. A device in combination according to claim 1, in which the end faces of said deviating roller are provided with a wear resistant cover layer.

8. A device in combination according to claim 1, in which said vat is provided with an overflow, and which includes bearings for said rolls, said bearings being located above said overflow.

* * * * *

UNITED STATES PATENT OFFICE

CERTIFICATE OF CORRECTION

Patent No. 4214461 Dated July 29, 1980

Inventor(s) Günter Schiffer et al

It is certified that error appears in the above-identified patent and that said Letters Patent are hereby corrected as shown below:

[75] Inventors: Günter Schiffer, Krefeld; Klaus Meisen, Tönisvorst; Rudolf Sonnen; Klaus Heidan, both of Krefeld, all of Fed. Rep. of Germany Signed and Sealed this

*Twenty-eighth* Day of *October 1980*

[SEAL]

*Attest:*

SIDNEY A. DIAMOND

*Attesting Officer*

*Commissioner of Patents and Trademarks*